United States Patent [19]

McCormick

[11] Patent Number: 4,903,989

[45] Date of Patent: Feb. 27, 1990

[54] BUSINESS FORM WITH PROTECTIVE COVER SHEET

[75] Inventor: Joseph A. McCormick, Manhattan, Ill.

[73] Assignee: General Credit Forms, Inc., Earth City, Mo.

[21] Appl. No.: 247,275

[22] Filed: Sep. 21, 1988

[51] Int. Cl.[4] ..... B41L 1/20

[52] U.S. Cl. ..... 282/9 R; 282/1 R; 282/8 R; 282/22 R

[58] Field of Search ..... 282/1 R, 8 R, 8 B, 8 A, 282/8 C, 9 R, 9 A, 10, 11, 11.5 R, 11.5 A, 22 R, 22 A, 23 R, 23 A, 24 R, 24 A, 24 B, 24 C

[56] References Cited

U.S. PATENT DOCUMENTS

| | | | |
|---|---|---|---|
| 4,248,919 | 2/1981 | Davis | 282/8 A X |
| 4,403,793 | 9/1983 | McCormick et al. | 282/9 R X |
| 4,611,826 | 9/1986 | Breen | 282/9 R X |
| 4,614,363 | 9/1986 | Breen | 282/9 R X |
| 4,667,984 | 5/1987 | Nitta | 282/8 R |
| 4,687,228 | 8/1987 | Van Malderhem et al. | 282/9 R |
| 4,730,848 | 3/1988 | McCormick | 282/8 R |

*Primary Examiner*—Paul A. Bell

*Attorney, Agent, or Firm*—Marshall, O'Toole, Gerstein, Murray & Bicknell

[57] ABSTRACT

An improved credit card formset having multiple transaction slips with a cover sheet for any transaction slips formed with an integral duplicating carbon surface, such as a carbon-on-back (COB) slip. The cover sheet is attached by bonding to one end of the COB slip. When the COB slip is detached from the formset the attached cover sheet is sized to overlay the duplicating carbon surface and thereby prevent undesired user contact with the carbon. Any carbonless copy paper (CCP) in the credit card formset or other pack of business forms is similarly covered by an attached cover sheet when the CCP sheet is removed from the pack to prevent undesired user contact with the resin material in the CCP sheet.

15 Claims, 5 Drawing Sheets

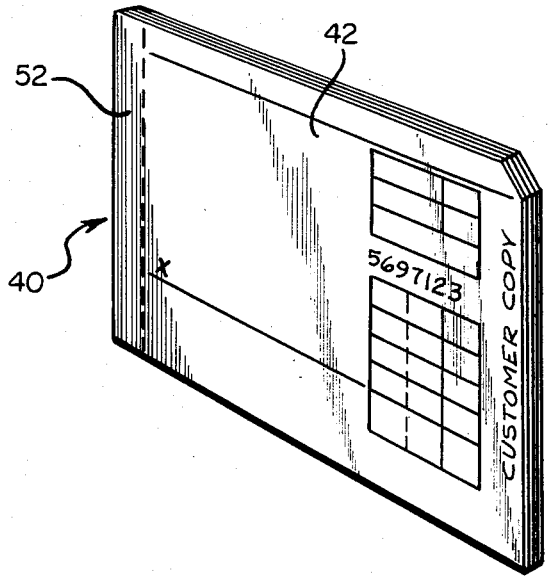
FIG. 6
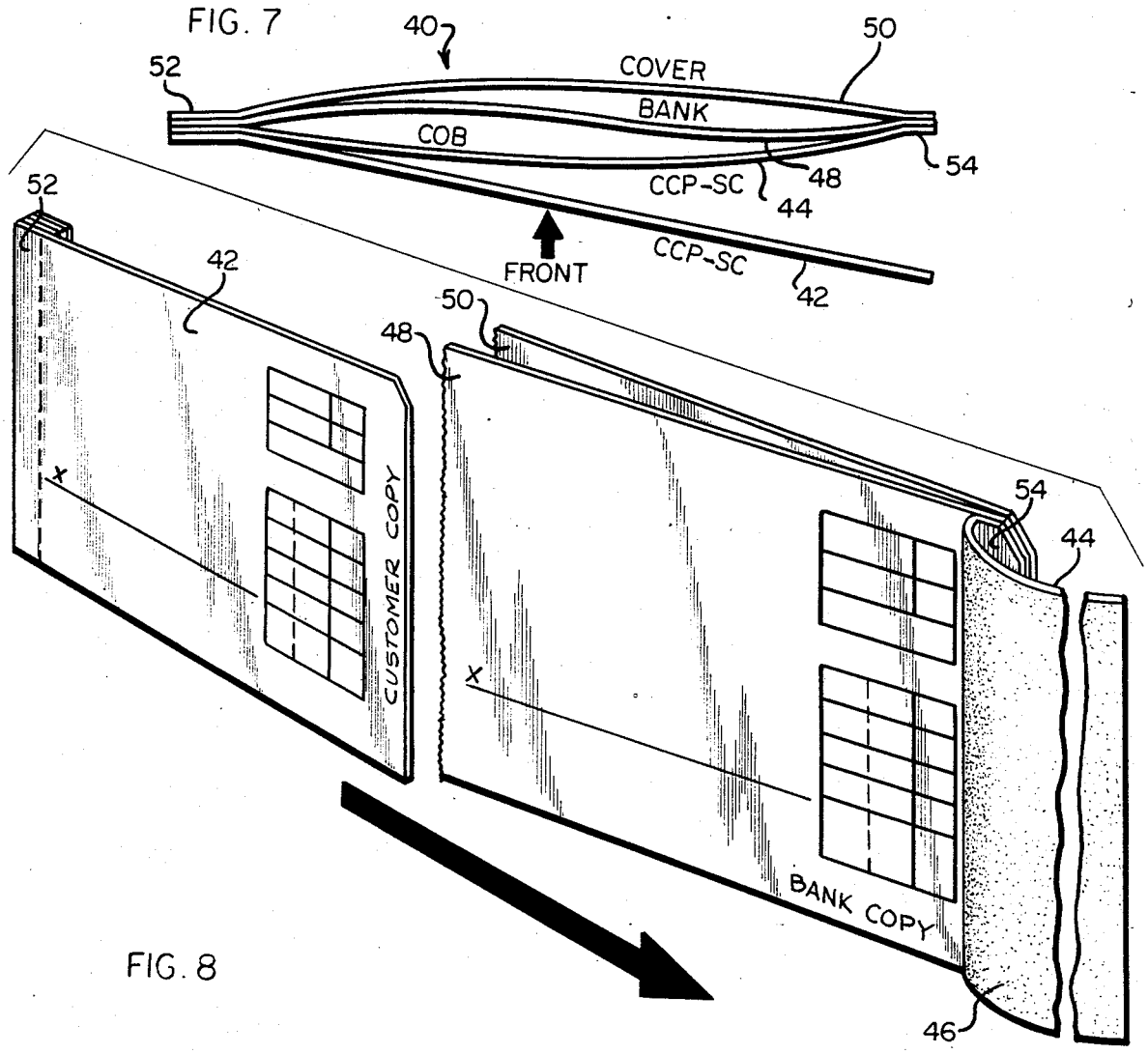
FIG. 7
FIG. 8

FIG. 9
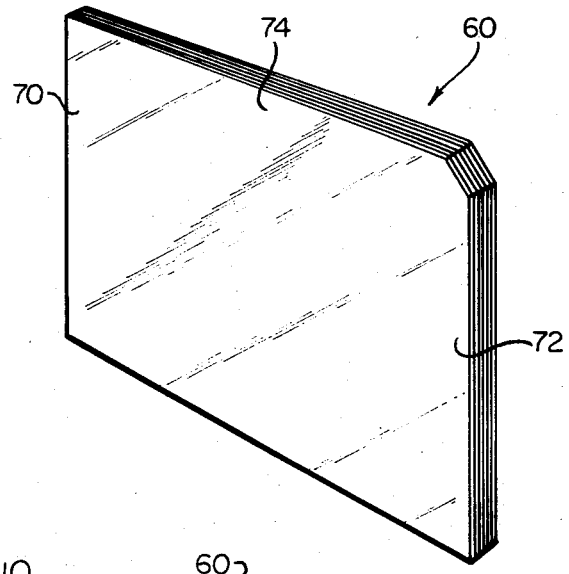
FIG. 10
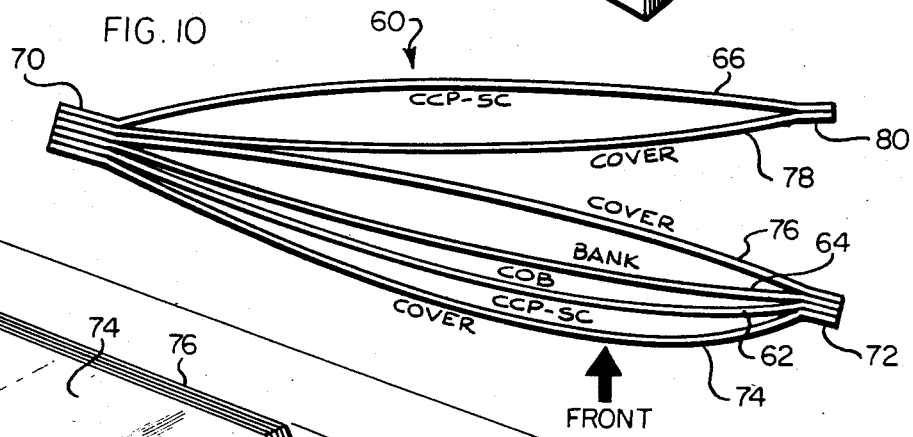
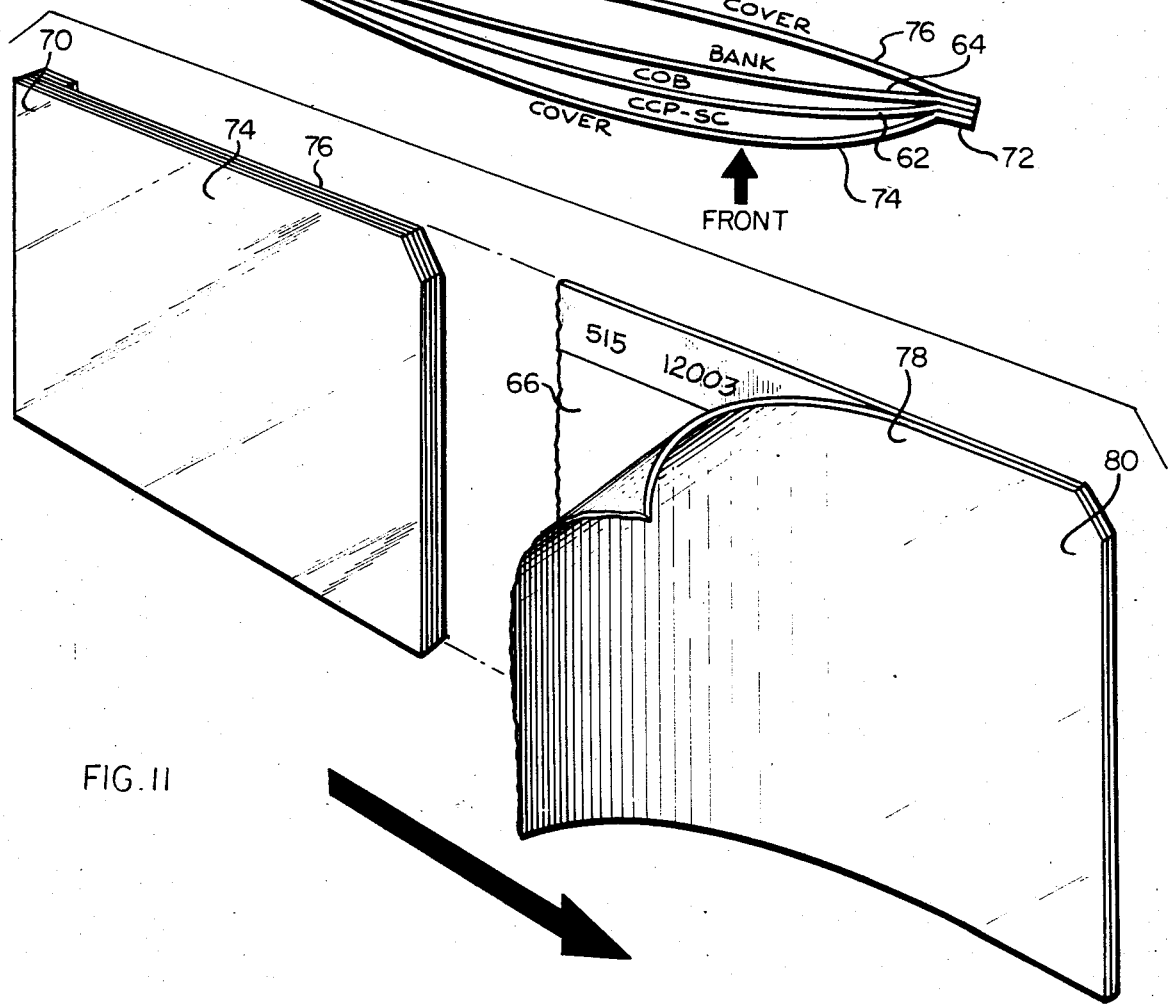
FIG. 11

BUSINESS FORM WITH PROTECTIVE COVER SHEET

This invention relates to business forms such as credit card transaction slips which are araanged in an assembled pack or "formset" of paper and duplicating carbon components with or without carbonless copy paper components to receive printed information, and in particular to an improved pack of credit card transaction slips for reducing the possibility of a user contacting the undesired portions of the duplicating carbon components and the carbonless copy paper components when these slips are detached from the pack.

BACKGROUND OF THE INVENTION

Reference may be made to the following U.S. Pat. Nos. 4,403,793; 4,611,826; 4,614,363; 4,687,228; 4,720,408; 4,741,558 of interest.

Credit card transactions are normally recorded on an assebled pack or "formset" of transaction slips or components for recording information on a merchant copy, customer copy, and a bank copy in a three ply formset, for example. Depending upon the number of such transaction slips contained in the pack, one or more separate duplicating carbon slips may be included. Alternatively, one or more of the transaction slips may be formed with the duplicating medium, normally carbon material, on the back of the slip, such transaction slips being commonly referred to as a carbon-on-back (COB) slip.

As indicated in the aforementioned U.S. Pat. No. 4,403,793, significant fraud problems arising from the use of separate duplicating carbon slips containing customer account information may be eliminated by the invention described therein in which the carbon slips are split apart to divide the customer's account number and are then thrown away to provide an industry recognized, effective fraud deterrent.

The use of carbon-on-back (COB) slips in a pack or formset also is an effective fraud deterrent because one of the parties—usually the merchant or customer will retain the transaction slip which is formed as a COB slip. However, the party retaining the COB slip is subjected to a potential messy and dirty situation in which the carbon can smudge fingers, clothing, and other documents and may also unintentionally ingest carbon particles and be subjected to further complications. Thus, if the COB slip is given to a customer, the carbon can readily smudge a purse, wallet, shirt pocket, and fingers while being temporarily carried to a place of more permanent storage where it can smudge other documents. Similarly, a COB slip retained by the merchant readily smudges a waiter/waitress' or clerk's hands, cash registers or other containers into which the COB may be temporarily placed prior to more permanent filing. Particularly in the case of a waiter/waitress or retail clerk handling a multitude of transactions during the day, carbon smudges built up on the handler's fingers and work area equipment is annoying and a nuisance to the handler as well as distasteful to the merchant's customers. In the case of waiters and waitresses the carbon smudges is a potential health hazard and could lead to violations of laws regulating the handling and preparing of restaurant food. These same problems exist when the party retains separate duplicating carbon slips as a fraud deterrent where these loose carbon slips are not split apart in accordance with the aforementioned U.S. Pat. No. 4,403,793.

An alternative to the separate duplicating carbon slips and the COB slips has been to use a carbonless copy paper (CCP). In some commercially available carbonless copy paper the CCP is formed by applying a resin coating on the front of a bottom sheet and with a top sheet having a coated back with a suspension of microcapsules that contain a colorless dye. Pressure on the front face of the top sheet ruptures the capsules on the coated back to allow the dye to react chemically with the resin on the coated front of the bottom sheet thereby resulting in dye visualization. These coated paper sheets or slips are known as "CCP-coated front (CF)" and "CCP-coated back (CB)". In other commercially available carbonless copy paper the resin and dye microcapsules are both coated on the same surface. These coated paper sheets or slips are known as "CCP-self-contained (SC)".

It has now been found that the resin on the coated front of the CCP appears to cause adverse reactions on persons contacting the resin as reported in "Acute Systemic Reactions To Carbonless Copy Paper Associated With Histamine Release", Dr. F. P. LaMarte, et al., *The Journal of The American Medical Association*, July 8, 1988, Vol. 260, #2, page 242–243. Because the CCP slip limits the need for using duplicating carbon slips, it is a useful fraud deterrent in credit card transactions. In addition sheets of CCP are extensively used in other business form packs, such as invoices, purchase orders, statements, internal memorandum, etc. Accordingly, it is desired to continue to utilize carbonless copy paper to obtain its benefits while attempting to eliminate the recently recognized detrimental effects of the CCP resin.

SUMMARY OF THE INVENTION

In accordance with the principles of the present invention, there is provided an improved business form such as a credit card transaction pack in which the transaction slip or other slip containing carbon, for instance a COB slip, is provided with an integral cover sheet which is attached to and stays with the COB slip to cover the carbon area when the COB slip is removed from the pack so as to thereby prevent COB holder contact with the carbon area. Normally, the COB slip is either the merchant copy which is retained by the merchant or a customer copy which is given to the customer.

In any event, in a preferred embodiment of the invention, the cover sheet right end is attached by an adhesive or other bonding technique to a right-hand end of the COB slip. The left end of the cover sheet is perforated in standard fashion to a left-hand stub of the entire pack. After the transaction has been completed and the respective merchant, bank, and customer slips are removed from the pack by breaking the perforations along the left-hand stub, and any additional transaction slips are removed from the right-hand stubs by breaking the standard perforations, the COB slip and cover sheet are still mounted together in such a manner as to cover the duplicating carbon medium on the back of the COB. The cover sheet thereby prevents undesired contact of the duplicating carbon by the COB holder.

The present invention can be applied to all of the standard packs presently available using COB slips. Thus, in a standard three-part formset in which the top, middle and bottom slips are respectively merchant copy, bank copy and customer copy, the top merchant copy is a COB slip with duplicating medium on the bottom thereof. In this three-part form, when the left-hand stub and the right-hand portion of the pack are moved away from each other, eventually, the merchant COB slip with duplicating carbon medium on the bottom is covered by the cover sheet which is still attached to the right-hand portion of the COB sheet. The same principles of this invention can be used to provide a cover sheet for any retained loose carbon slips which are not split apart and thrown away.

In another three-part transaction form currently available, the top, middle and bottom slips are respectively customer, merchant and bank copies. In this form, the middle merchant copy is a COB slip with a duplicating carbon medium on the bottom. After eventually splitting the slips from the form, the merchant is left with his COB slip having a cover sheet covering the bottom duplicating carbon medium to prevent undesired contact with the carbon area. Other standard forms utilize the COB slip as the customer copy. The principles herein can readily be adapted in a similar manner to cover the carbon area of the COB customer slip or any other so designated COB slip in the pack as well as any other utilized duplicating carbon slips having a duplicating carbon surface on one or both faces thereof.

In accordance with another aspect of the present invention there is provided an improved pack of business forms containing one or more sheets of carbonless copy paper (CCP) and a respective cover sheet for each CCP resin bearing surface so that upon detaching the CCP from the pack, any CCP resin bearing surface is covered and the holder is protected from undesired contact therewith.

As an example, in the above first mentioned three-part formset with merchant, bank and customer copies attached top to bottom, the top merchant copy is a carbonless copy paper (CCP) of the self-contained type on the front face in addition to being the aforementioned COB slip with carbon on the back face. In this formset the top merchant copy is therefore a CCP/COB slip. The bottom customer copy is also a CCP slip of the self-contained type.

In accordance with this aspect of the present invention, a tissue cover sheet overlies the top CCP slip and is attached to the front face of the top CCP slip with suitable adhesive at the right end thereof and by perforations to the left-hand stub of the pack. Similarly, a second tissue cover overlies the bottom CCP slip and is provided over the front face of the bottom CCP slip with its right end attached to the right-hand portion of the CCP slip and its left end attached by perforations to the lefthand stub of the pack.

When the transaction is completed and the slips are removed from the pack left-hand stub, the top CCP/COB slip has: (1) the attached tissue sheet covering the resin material on the top CCP face of the merchant copy, as well as: (2) the aforementioned attached cover sheet covering the carbon bottom in the COB portion of the merchant copy. Both the top tissue sheet and the bottom cover sheet are attached to the CCP/COB merchant copy at least along one edge such as the right-hand edge and otherwise completely cover both the top CCP resin face and the bottom COB face so that persons handling the merchant copy will not come in contact with the CCP resin or the duplicating carbon. Also, the bottom transaction slip, normally designated as the customer copy has its CCP top face bearing the resin protected by an overlying tissue cover sheet which is attached to the bottom transaction slip at least along one edge, such as the right-hand edge.

Therefore, in accordance with the principles of the present invention, any duplicating carbon or other medium on a COB slip or other duplicating carbon slip in a business form pack and any CCP sheet or slip with a coated surface bearing a CCP resin, is protected with an appropriate cover sheet which remains with the COB slip and the CCP sheet or slip to protect the holder of the COB or the CCP so long as this is desired. Carbon smudges and other annoyances from the duplicating medium on the COB slip and any possible adverse reactions due to the resin material in present CCP sheets or slips are therefore substantially reduced and for all practical purposes eliminated by the present invention.

BRIEF DESCRIPTION OF THE DRAWINGS

The features of this invention which are believed to be novel are set forth with particularity in the appended claims. The invention may be best understood by reference to the following description taken in conjunction with the accompanying drawings, in which like reference numerals identify like elements in the several figures and in which:

FIG. 3 is an exploded perspective view illustrating the bottom slip torn away from the remaining two slips and cover sheet;

FIG. 6 is a perspective view of another embodiment of the present invention illustrating another three-part transaction pack;

FIG. 7 is a schematic diagram presented for convenience in illustrating the disposition in the pack of FIG. 6 of the top, middle and bottom transaction slips and a cover sheet in accordance with the principles of the present invention;

FIG. 8 is a perspective view illustrating the top slip torn away from the remaining middle and bottom slips with the cover sheet;

FIG. 9 is a perspective view illustrating still another embodiment of the invention in a three-part credit card transaction pack;

FIG. 10 is a schematic diagram of the pack of FIG. 9 presented for convenience in illustrating the disposition of the top, middle and bottom transaction slips with two tissue cover sheets and an additional cover sheet in accordance with the present invention;

FIG. 11 is a perspective view illustrating the bottom transaction slip and tissue cover sheet torn away from the pack;

DETAILED DESCRIPTION

Figure 1:
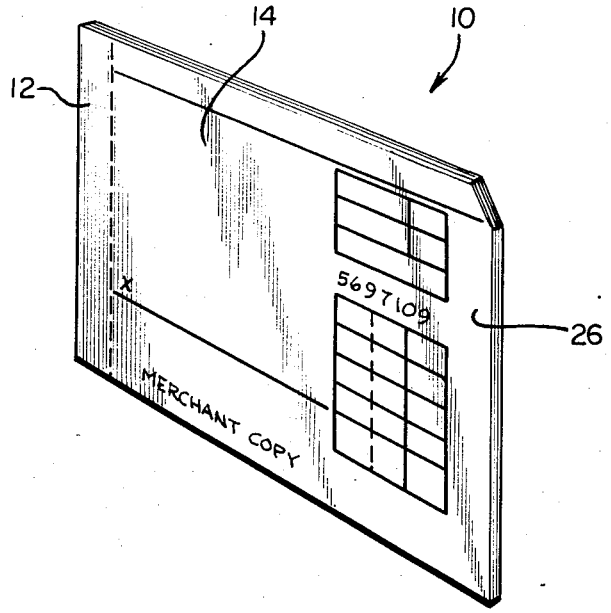
FIG. 1 is a perspective view of an assembled three-part credit card transaction pack constructed in accordance with the principles of the present invention.
Figure 2:
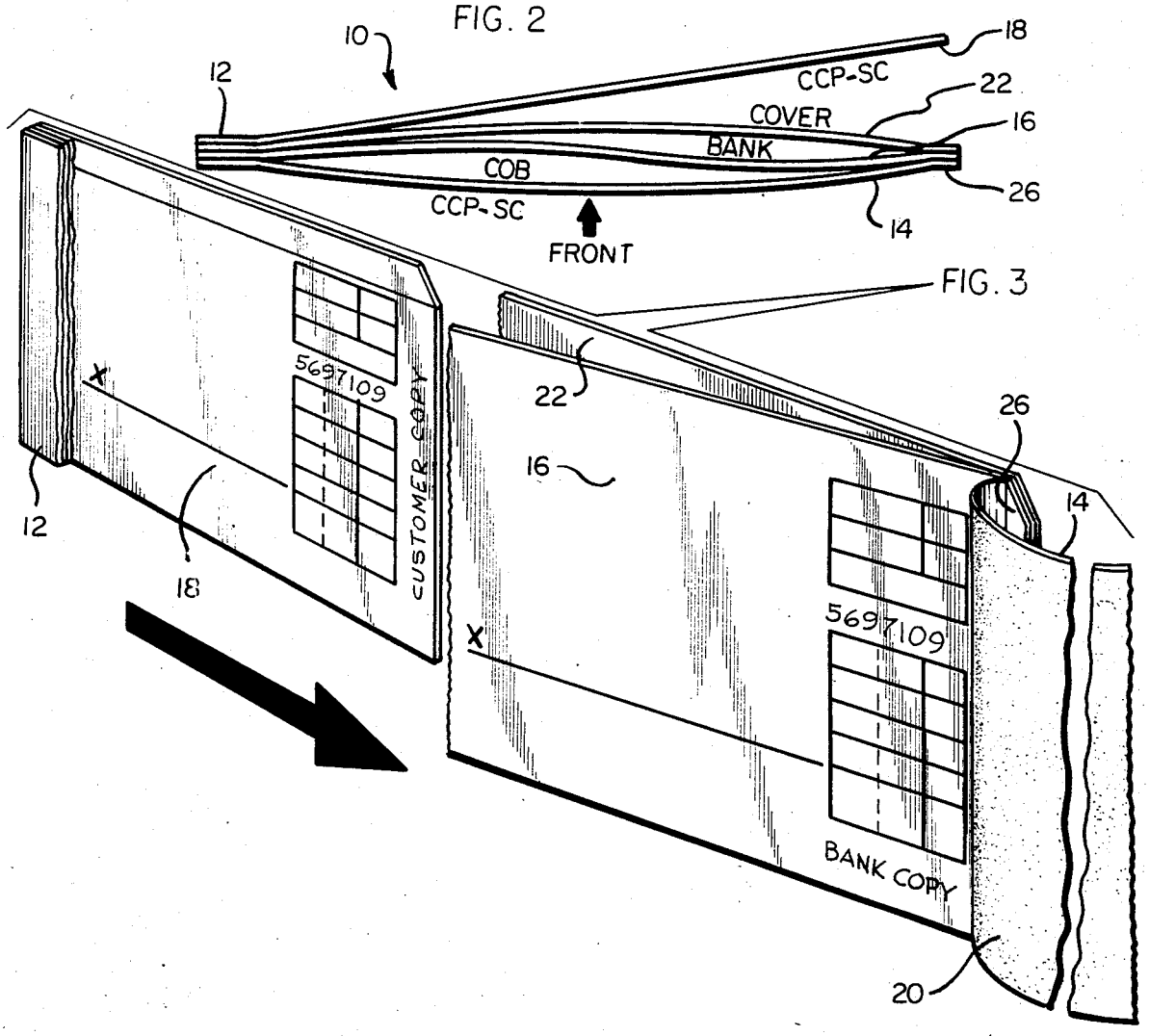
FIG. 2 is a schematic diagram utilized for convenience in illustrating the disposition in the pack of FIG. 1 of the three transaction slips and a cover sheet in accordance with the present invention.

FIG. 1 illustrates a credit card transaction pack or "formset" containing three transaction slips and a cover sheet constructed in accordance with the principles of the present invention. Three-part pack or formset 10 contains three transaction slips each detachably joined to a pack stub 12 with perforations at least at one end of the pack. The relative top to bottom disposition of the slips in the pack is most clearly seen with reference to FIG. 2 wherein there is illustrated top transaction slip 14, middle transaction slip 16, and bottom transaction slip 18.

Figure 4:
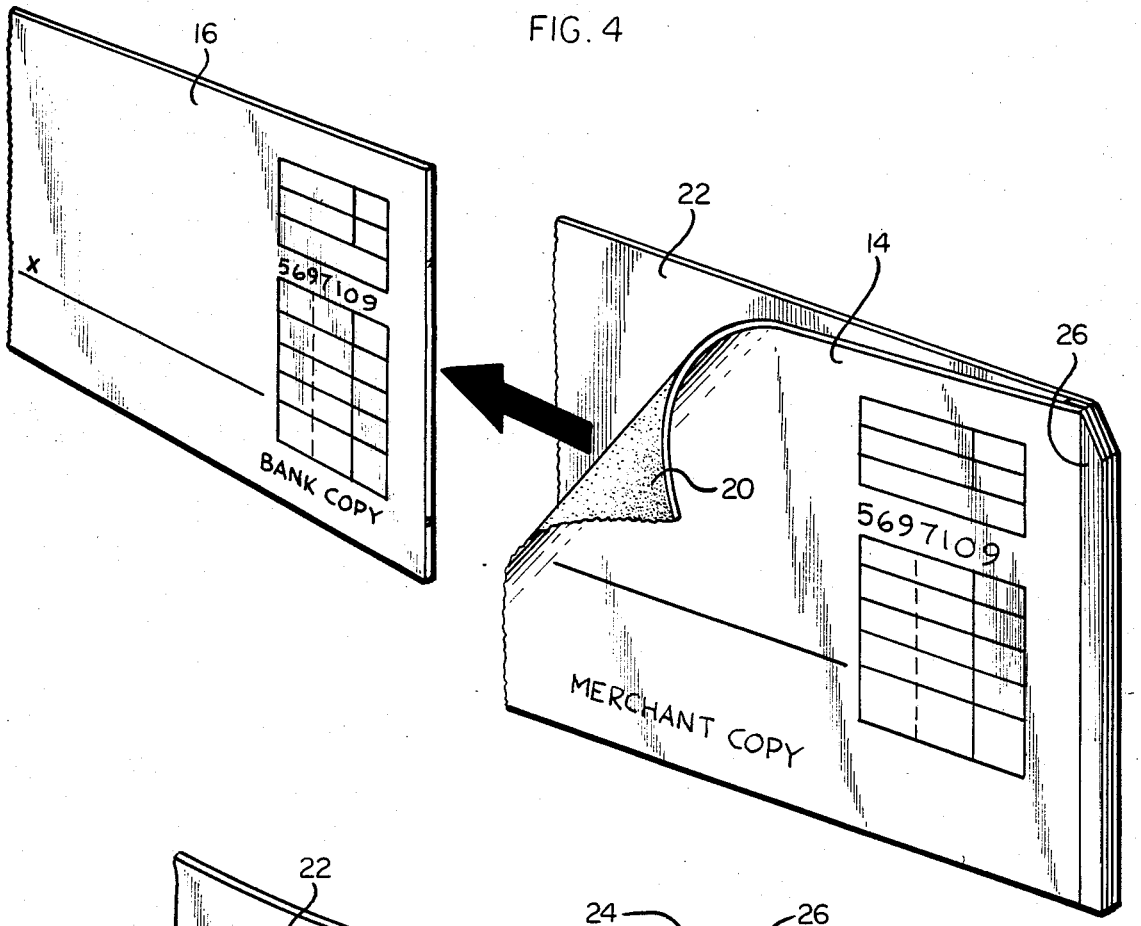
FIG. 4 is a perspective view illustrating the middle transaction slip torn away from the remaining top slip and cover sheet of the embodiment shown in FIG. 1.
Figure 5:
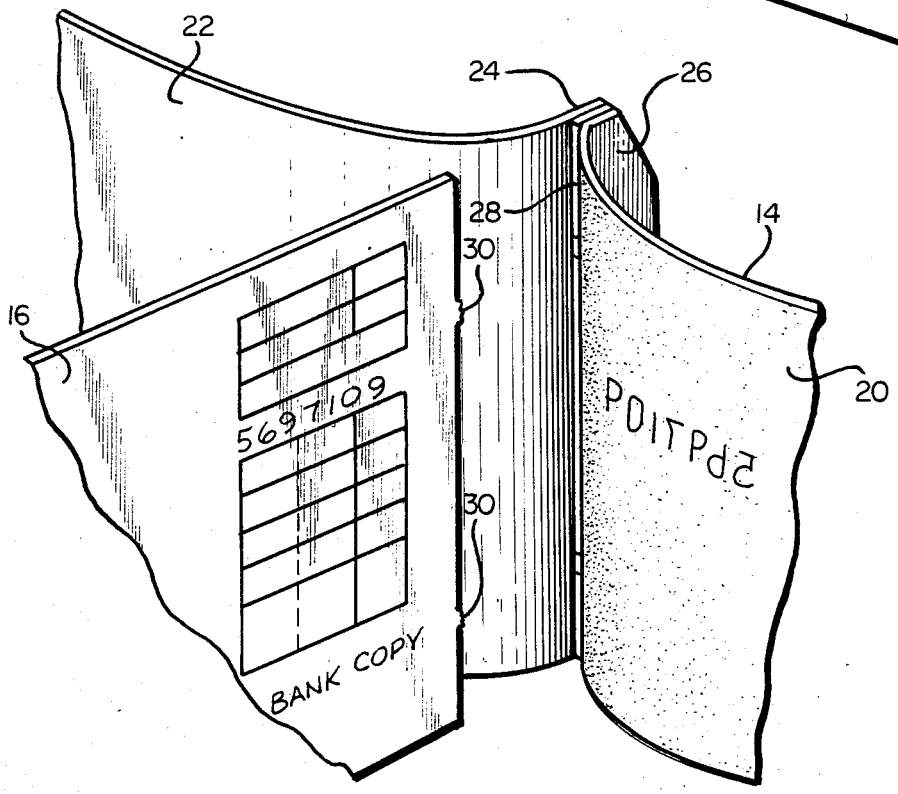
FIG. 5 is a fragmented perspective view illustrating joinder of the middle slip to the top slip and cover sheet.

Normally, one slip is a merchant copy, another is a bank copy, and a third is the customer copy. In the present illustration of an embodiment of the invention, top transaction slip 14 is a merchant copy, middle transaction slip 16 is a bank copy, and bottom transaction slip 18 is a customer copy. In most cases, it is desired that the bank copy be formed with carbon images due to the requirements of optical character reading equipment. In that case, if the bank copy is made the middle transaction slip 16 as illustrated in connection with FIGS. 1 and 2, then top transaction slip 14 must be formed as a carbon-on-back (COB) slip to enable carbon imprinting of images on the bank copy. As shown in FIGS. 3–5, top transaction slip 14 is formed as a COB having a duplicating medium such as carbon coated on the back face 20 of slip 14. Alternatively, instead of the carbon coating, a separate carbon sheet may be attached to the back of slip 14 so that back face 20 is formed of the carbon sheet. The front face of transaction slip 14 as well as the front face of transaction slip 18 is formed as a carbonless copy paper (CCP) of the self-contained type, i.e., CCP-SC, having both dye microcapsules as well as resin material in the coating applied to the respective transaction slip faces.

Therefore, in accordance with the standard imprinting operation, the customer's credit card is placed on the bottom of an imprinting mechanism and covered by pack 10 with a roller then rolled over the surface of pack 10 to imprint information such as the customer's account number, retail store number, date, etc., on the front faces of slips 14 and 18. This front face imprinting is enabled due to these forms being self-contained CCP slips. In addition, the same information is imprinted on the front of bank copy 16 using the duplicating carbon medium formed on back face 20 of COB slip 14 which overlies bank copy 16.

In accordance with the principles of the present invention, a cover sheet 22 is provided in pack 10 with one sheet end detachably mounted to stub 12. The other end of cover sheet 22 includes a mounting end 24 which is affixed to mounting end 26 of COB slip 14 through an intermediate stub 28 of bank copy 16. Stub 28 and mounting ends 24, 26 are bonded together such as by a suitable adhesive, crimping, or a heat treatment technique. Middle transaction slip 16 is detachably mounted to stub 28 by means of two small nib connections 30. Alternatively, middle transaction slip 16 could have a free right end rather than be connected with nibs 30 to the right ends of slip 14 and cover sheet 22.

Referring to FIGS. 3–5, there is illustrated the manner in which the present invention provides the carbon face 20 on COB slip 14 covered with cover sheet 22 when the COB slip is finally detached from pack 10. Thus, when the person is handling the detached merchant copy 14 as shown in FIG. 4, cover sheet 22 attached at end 26 prevents the holder from coming in contact with the duplicating carbon medium on face 20. Similarly, cover sheet 22 prevents the carbon on face 20 from making dirty smudges on clothing, storage units, file folders, etc. Where a separate duplicating carbon slip with a carbon surface (not a merchant, bank, or customer copy) is to be removed from the pack and retained, a cover sheet like sheet 22 can be provided in the pack in accordance with the present invention to cover the carbon surface. If a double faced carbon is used, respective cover sheets can be provided in accordance with the present invention.

Although cover sheet 22 is shown as attached at its right end to COB slip 14 with the left end free when removed from pack 10, it is understood that if desired, the left end edge of cover sheet 22 could be affixed by a binder, such as an adhesive, to COB slip 14 with the right end free when the COB and cover sheet combination is removed from the pack. In this instance the COB and cover sheet could both include perforations attaching these adhesive bound sheets to the pack left end stub so they can be detachably removed therefrom. Alternatively, all of the other sheets in the pack except for the cover sheet and COB could be connected by perforations to the left hand stub. When all of the perforated sheets are removed from the pack, the cover sheet and COB remain attached together at the left stub.

It is preferred that cover sheet 22 is formed of a light weight paper sufficient to permit legible characters to appear on bottom slip 18 when writing on top slip 14. Cover sheet 22 may be transparent, translucent, or opaque, if desired, and may be formed of any color. Under normal circumstances, there appears to be a sufficient buildup of static electricity between the smooth carbon surface on face 20 and a light weight cover sheet 22 so that the two pieces lie very close together and are maintained in such a position when removed from the pack. If desired a dry gum or pressure sensitive adhesive area can be used on the front of the cover sheet 22 and suitably activated to more securely retain the cover sheet bonded to the carbon surface when they are removed from the pack.

FIGS. 6–8 illustrate the present invention applied to a three-part transaction pack in which the bank copy is the bottom ply rather than the middle ply as discussed in connection with the first embodiment. Referring to FIGS. 6 and 7, pack 40 includes a top transaction slip 42, middle transaction slip 44 and bottom transaction slip 48. Normally, in pack 40, the respective transaction slips from top to bottom are the customer copy, merchant copy and bank copy.

Top slip 42 has a CCP-self-contained top surface (CCP-SC) and a CCP-coated back (CCP-CB) on the bottom surface. Middle slip 44 has a CCP-coated front (CCP-CF) on the front surface and a COB duplicating carbon on the back or bottom surface 46. As in the first embodiment, the carbon surface may be formed by a separate carbon sheet attached to the COB bottom. Bottom slip 48 is a plain hard copy which receives the carbon imprint from carbon surface 46 on COB slip 44. Alternatively, top slip 42 and middle slip 44 both may have a CCP-self-contained top surface. The bottom surface of middle slip 44 has a COB duplicating carbon on the bottom surface 46.

Cover sheet 50, formed similar to cover sheet 22, is mounted in the pack by detachable means such as a perforated strip connected to pack stub 52. Stub 52 connects all of the transaction slips and cover sheet 50 at the left-hand side of pack 40. At the right-hand edge of the pack, COB slip 44, bottom slip 48 and cover sheet 50 are connected together in a manner similar to that shown in FIGS. 3–5 in connection with the first embodiment. Thus, bottom slip 48 which is normally the bank copy is connected with suitable nibs such as nibs 30 to a right-hand end 54 joining slips 44, 48 and cover sheet 50.

In use, after the user imprints pack 40, stubs 52 and 54 are grasped and moved away from each other to tear the perforations and thereby tear away slips 44, 48 and cover sheet 50 from slip 42 as shown in FIG. 8. The user may then remove bank copy 48 by detaching the right-hand edge of slip 48 from stub 54 in the manner as shown in FIGS. 4 and 5 in connection with the first embodiment. Alternative, the bank copy can remain with stub 52 when the stubs are separated. In any event, the user is finally left with detached merchant copy 44 which is a COB slip covered by cover sheet 50.

Thus, the first and second embodiments illustrate the principles of the present invention applied to packs in which a cover sheet has been provided for the detached COB slip, regardless of positioning of the COB slip in the particular pack. From the descriptions herein and the illustrations of the first two embodiments, those skilled in the art can readily apply the present invention to other packs or formsets in which the COB slip is in other locations in the pack rather than being the top slip as in pack 10 or the middle slip as in pack 40.

In accordance with another aspect of the present invention, a cover sheet is provided for not only the COB slip in the pack, but also for any CCP slips in the pack so as to prevent any adverse reaction from the resin material presently used in carbonless copy paper (CCP). This aspect of the present invention is hereinafter described in connection with FIGS. 9–12.

Pack 60 is formed with transaction slips similarly disposed as in pack 10 described and illustrated in connection with the first embodiment. Accordingly, pack 60 includes top transaction slip 62, middle transaction slip 64 and bottom transaction slip 66. Normally, the transaction slips from top to bottom (or front to back) are designated as the merchant copy, bank copy and customer copy respectively.

Top slip 62 has a CCP-self-contained top or front surface (CCP-SC) and a COB duplicating carbon bottom surface 68. Transaction slip 64 is a plain, hard copy which receives carbon imprint from COB 68. Bottom transaction slip 66 has a CCP-self-contained surface (CCP-SC) on the top or front face.

Transaction slips 62 and 64 are detachably mounted in pack 60 to a left-hand stub 70 by means of perforations and are detachably mounted to each other on right end stub 72 by means of a detachable stub connection such as shown in FIGS. 3–5 in connection with the first embodiment. A cover sheet 74 is mounted at the top or front of 60 by means of a detachable connection to left-hand stub 70 and by bonding attachment means such as a suitable adhesive at its right end to stub 72. Cover sheet 74 is a thin, tissue paper sufficiently transparent so that the characters and form lines on the top or front surface of top transaction slip 62 can be seen when viewed through cover sheet 74.

A cover sheet 76, formed similar to cover sheets 22 and 50, is mounted in the pack by being detachably mounted to stub 70 at its left end and by bonding attachment means such as a suitable adhesive at its right end to stub 72. Thus, initially, transaction slips 62 and 64 along with cover sheets 74, 76 are detachably mounted into stub 70 at the left end of pack 60, and are mounted together at their respective right ends to stub 72 with only slip 64 being detachable therefrom. Cover sheet 78 is detachably mounted in pack 60 at its left end to stub 70, whereas the right end of cover sheet 78 is adhesively mounted to the right-hand edge of bottom slip 66. Cover sheet 78 may also be a sufficiently transparent, tissue sheet similar to tissue cover sheet 74.

In use, the user can write on cover sheet 74 by viewing the designated places on the form of transaction slip 62 when viewed through the transparent sheet 74. Imprinting of the customer account information, date, etc. is provided in accordance with the standard roller imprinting practice previously described. If the user grasps stub 70 in one hand and the right-hand adhesively joined end 80 of slip 66 and cover sheet 78 in the other hand, and moves the hands apart, the result will be as shown in FIG. 11. In this case, the connected combination of slips 62, 64 and cover sheets 74, 76 are still connected to left-hand stub 70 whereas slip 66 and cover sheet 78 have been torn away from stub 70. Note that cover sheet 78 covers the top or front CCP surface of slip 66 so as to prevent undesired contact of the user with the CCP resin.

Figure 12:
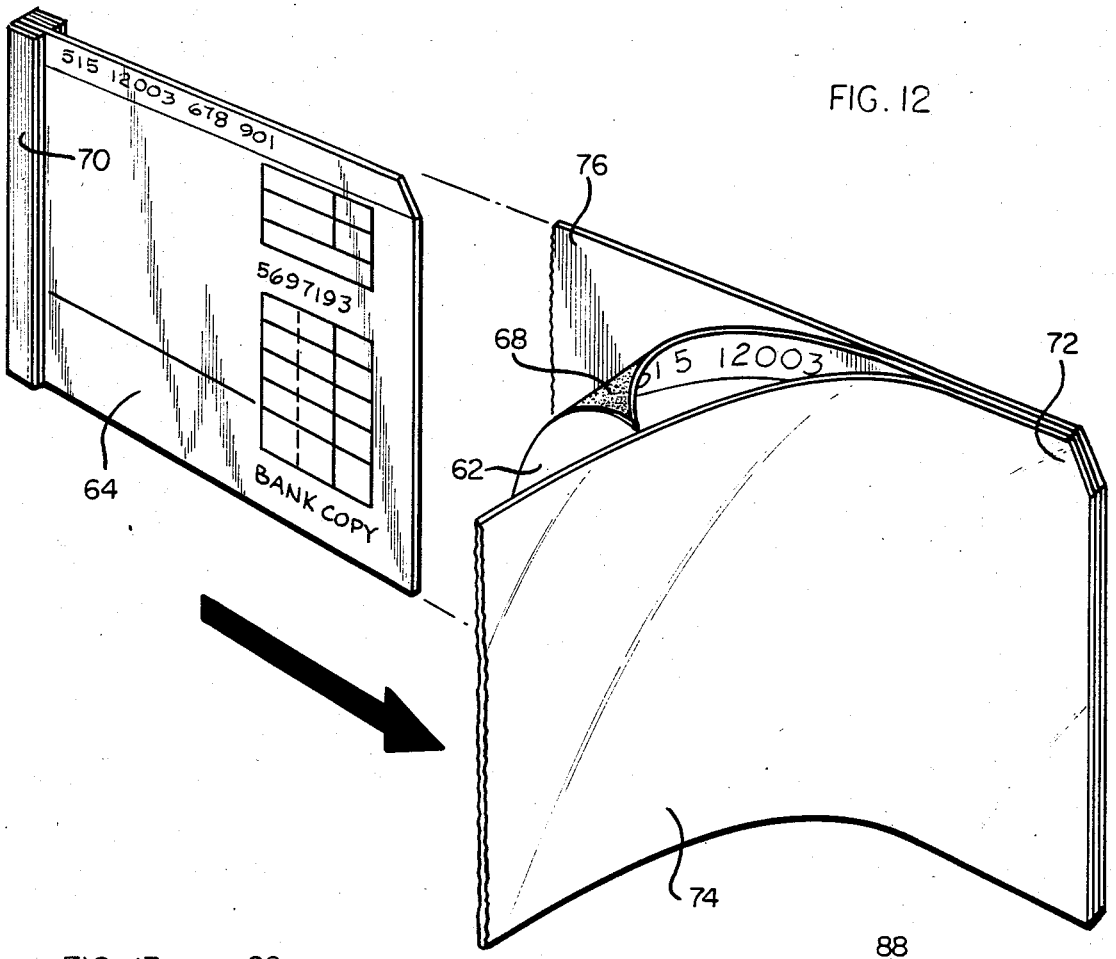
FIG. 12 is a perspective view illustrating the middle slip torn away from the remaining top slip, top tissue cover sheet and bottom cover sheet in accordance with the invention.

Moving stub 70 away from stub 72 enables bank copy 64 to be detached at its right end from stub 72 as in FIG. 12. Alternatively the bank copy can remain attached to stub 72 and then be removed from stub 72. In any event, this leaves detached slip 62 with its CCP-self-contained top or front surface covered by cover sheet 74 and its COB surface 68 covered by cover sheet 76. Therefore, the user is also protected from undesired contact with both the CCP surface and the COB surface on detached slip 62.

It is to be understood that the principles of the present invention relating to providing a COB cover and/or a CCP-resin cover when the COB and/or CCP-resin sheet is detached from a pack can be utilized in other types of business forms packs in addition to the presently described credit card transaction packs. Thus, CCP-resin sheets presently used in business formsets of invoices, purchase orders, statements, etc. can, if desired, include a cover sheet to cover the resin area on a CCP coated front or a CCP-self-contained sheet when detached and removed from the formset.

Figure 13:
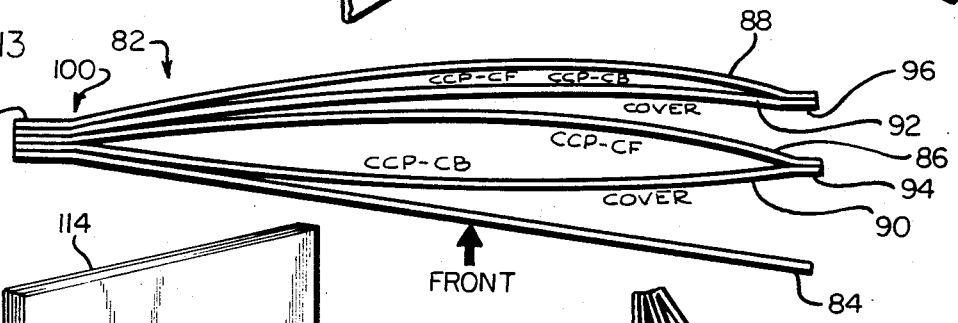
FIG. 13 is a schematic diagram illustrating another embodiment of the present invention in a pack of business forms having only caronless copy paper sheets.

As an example, FIG. 13 schematically illustrates a pack of business forms 82 which may be credit card transaction slips, invoices, purchase orders, etc. Pack 82 includes three sheets on which information is recorded, namely, a first or top sheet 84 a second or middle sheet 86 and a bottom or last sheet 88. Top sheet 84 is of plain paper so that the user can write on the front thereof, the front being indicated by the reference arrows in FIG. 13. Middle sheet 86, is a carbonless copy paper - coated front (CCP-CF), and bottom sheet 88 is also a CCP-CF sheet. A first cover sheet 90 and a second cover sheet 92 are each formed of carbonless copy paper - coated back (CCP-CB) so that when the user writes on the front of sheet 84 the corresponding pressure provides dye visualization on the coated front of sheets 86 and 88.

Cover sheet 90 is bonded such as by a suitable adhesive at end 94 to one end of sheet 86. Similarly, sheet 92 is bonded at end 96 to sheet 88. All of the sheets 84–92 are connected together at a stub end 98 and can be detached from the stub by means of respective perforations 100 in each sheet.

In use, after the desired information has been recorded on the front of sheet 84 and has been thereby imprinted on sheets 86 and 88, the user may move stub 98 away from end 94 so as to break the respective perforations 100 on sheets 86 and 90. This removes information sheet 86 and the attached cover sheet 90 from pack 82 and provides a cover for the CCP-CF resin surface on sheet 86. A similar cover of the CCP-CF resin surface on information sheet 88 is provided by cover sheet 92 upon removal of these sheets from pack 82.

Figure 14:
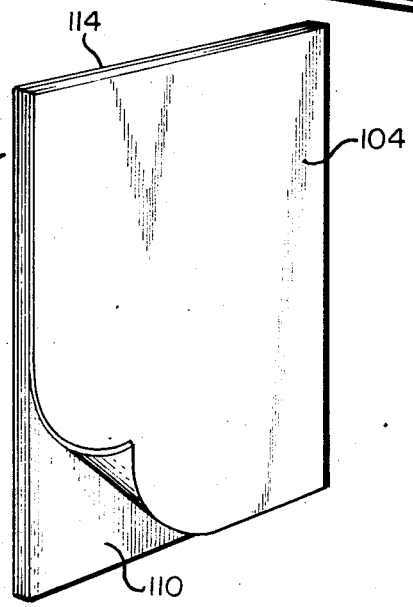
FIG. 14 is a perspective view illustrating still another business formset embodiment of the present invention having only carbonless paper sheets.
Figure 15:
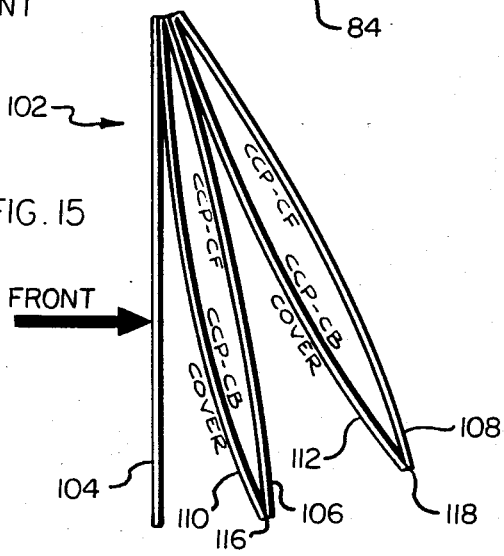
FIG. 15 is a schematic diagram illustrating the business formset of FIG. 14.

Rather than binding the cover sheet to the information sheet or transaction slip along a strip or stub portion along one end thereof, the connection can be made by binding the very edges together such as by means of an adhesive edge binder. For example, reference may be made to FIGS. 14 and 15 wherein pack 102 of business forms having information sheets 104, 106 and 108 along with cover sheets 110, 112 are each joined at one pack end by means of a binder such as an adhesive strip 114 connecting the edges of all of the sheets together.

A similar adhesive edge binder 116 connects the edges of sheets 106, 110. A similar edge adhesive 118 binds the edges of sheets 108, 112.

Writing of information into form 102 and the detaching of the information sheets to enable a respective cover sheet to cover the CCP resin surface is the same as previously described in connection with other embodiments of this invention.

It is understood of course that the cover sheets illustrated herein can be any desired color. In addition, in certain instances it may be desired to have the cover sheet contain a CCP-coated back where the cover sheet overlies a CCP-coated front slip. For instance, cover sheets 22, 74 or 78 can be formed with a CCP-coated back or bottom if the top or front surfaces of respective slips 18, 62, 66 are formed with a CCP-coated front. Such a situation is illustrated for example in the business formsets of FIGS. 13–15.

Also, it can be readily understood from the principles of the present invention how to apply a cover sheet for the COB slip or CCP slip in a four-part or five-part transaction pack so that in accordance with this invention when the COB or CCP slip is finally removed and detached from the pack, the COB surface and the CCP surface, if desired, are both covered by protective sheets in the manner of FIGS. 4, 8, 11 and 12.

The foregoing detailed description has been given for clearness of understanding only, and no unnecessary limitations should be understood therefrom, as modifications will be obvious to those skilled in the art.

What is claimed:

1. In a pack of detachably joined paper sheets, wherein at least one of said paper sheets includes a duplicating carbon surface on one face thereof, the improvement comprising a cover sheet adapted in size to cover said duplicating carbon surface, and attachment means for attaching one end of the cover sheet to a respective end of said paper sheet to enable the cover sheet to lay in a covering position adjacent the duplicating carbon surface when said paper sheet and cover sheet are removed from the pack, thereby inhibiting user contact with the duplicating carbon surface during handling of said removed paper sheet.

2. In a pack of detachably joined paper sheets, wherein at least one of said paper sheets is formed of carbonless copy paper and includes a carbonless copy surface on one face thereof, the improvement comprising a cover sheet adapted in size to cover said carbonless copy surface, and attachment means for attaching one end of the cover sheet to a respective end of said paper sheet to enable the cover sheet to lay in a covering position adjacent the carbonless copy surface when said paper sheet and cover sheet are removed from the pack, thereby inhibiting user contact with the carbonless copy surface during handling of said removed paper sheet.

3. In a pack of detachably joined credit card transaction slips including at least a first of said transaction slips having a duplicating carbon surface on one side thereof and a second of said transaction slips is formed of carbonless copy paper and includes a carbonless copy surface on one face thereof, the improvement compriing:

a first cover sheet adapted in size to cover said duplicating carbon surface;

first attachment means for attaching one end of said first cover sheet to a respective end of said first transaction slip to enable the cover sheet to lay in a covering position adjacent the duplicating carbon surface when the first transaction slip and first cover sheet are removed from the pack; thereby inhibiting user and other contact with the duplicating carbon surface during handling of the removed first transaction slip;

a second cover sheet adapted in size to cover said carbonless copy surface; and second attachment means for attaching one end of the second cover sheet to a respective end of said second transaction slip to enable the second cover sheet to lay in a covering position adjacent the carbonless copy surface when said second transaction slip and second cover sheet are removed from the pack, thereby inhibiting user contact with the carbonless copy surface during handling of said removed second transaction slip.

4. In a pack of detachably joined credit card transaction slips and at least one duplicating carbon slip having a duplicating carbon surface on one side thereof, wherein one of said transaction slips is disposed opposite said duplicating carbon surface for receiving a carbon imprint therefrom, the improvement comprising a cover sheet adapted in size to cover said duplicating carbon surface, and attachment means for attaching one end of the cover sheet to a respective end of the duplicating carbon slip to enable the cover sheet to lay in a covering position adjacent the duplicating carbon surface when the duplicating carbon slip and cover sheet are removed from the pack, thereby inhibiting user contact with the duplicating carbon surface during handling of the removed duplicating carbon slip.

5. In a pack of detachably joined credit card transaction slips including at least a first of said transaction slips having a duplicating carbon surface on one side thereof and a second of said transaction slips disposed opposite said duplicating carbon surface for receiving a carbon imprint therefrom, the improvement comprising a cover sheet adapted in size to cover said duplicating carbon surface, and attachment means for attaching one end of the cover sheet to a respective end of the first transaction slip to enable the cover sheet to lay in a covering position adjacent the duplicating carbon surface when the first transaction slip and cover sheet are removed from the pack, thereby inhibiting user contact with the duplicating carbon surface during handling of the removed first transaction slip.

6. A pack of credit card transaction slips according to claim 5, wherein said attachment means includes bonding means for bonding said one end of the cover sheet to said respective end of the first transaction slip.

7. A pack of credit card transaction slips according to claim 5, including a first stub adapted for detachably joining said transaction slips at one pack end, and wherein said attachment means includes a second stub at said respective end of the first transaction slip opposite the first stub at the one pack end, said first and second stubs adapted for movement away from each other to remove the first transaction slip and attached cover sheet from the pack.

8. A pack of credit card transaction slips according to claim 7, wherein said attachment means includes bonding means for bonding said one end of the cover sheet to said respective end of the first transaction slip at the second stub.

9. A pack of credit card transaction slips according to claim 8, including means for detachably joining the cover sheet to said first stub to enable removal of the cover sheet from the pack when the first and second stubs are moved away from each other.

10. A pack of credit card transaction slips according to claim 9, wherein said second stub at said respective end of the first transaction slip is formed as a stub extension of one end of said second transaction slip, said stub extension disposed between said first transaction slip and the cover sheet at said respective end of the first transaction slip, and break away means between said stub extension and said one end of said second transaction slip for removal of said second transaction slip from the first transaction slip and attached cover sheet.

11. In a pack of detachably joined credit card transaction slips, wherein at least one of said transaction slips is formed of carbonless copy paper and includes a carbonless copy surface on one face thereof, the improvement comprising a cover sheet adapted in size to cover said carbonless copy surface, and attachment means for attaching one end of the cover sheet to a respective end of said transaction slip to enable the cover sheet to lay in a covering position adjacent the carbonless copy surface when said transaction slip and cover sheet are removed from the pack, thereby inhibiting user contact with the carbonless copy surface during handling of said removed transaction slip.

12. A pack of credit card transaction slips according to claim 11, wherein said attachment means includes bonding means for bonding said one end of the cover sheet to said respective end of the transaction slip.

13. A pack of credit card transaction slips according to claim 11, including a first stub adapted for detachably joining said transaction slip at one pack end opposite the respective end of the transaction slip, said first stub and said respective end of the transaction slip adapted for movement away from each other to remove the transaction slip and attached cover sheet from the pack.

14. A pack of credit card transaction slips according to claim 13, wherein said attachment means includes bonding means for bonding said one end of the cover sheet to said respective end of the transaction slip.

15. A pack of credit card transaction slips according to claim 14, including means for detachably joining the cover sheet to said first stub to enable removal of the cover sheet from the pack when the first stub and said respective end of the transaction slip are moved away from each other.

* * * * *